US011506382B2

(12) United States Patent
Hakim Doisneau et al.

(10) Patent No.: US 11,506,382 B2
(45) Date of Patent: Nov. 22, 2022

(54) SYSTEM AND METHOD FOR ACOUSTIC DAMPERS WITH MULTIPLE VOLUMES IN A COMBUSTION CHAMBER FRONT PANEL

(71) Applicant: General Electric Company, Schenectady, NY (US)

(72) Inventors: Layal Hakim Doisneau, Aargau (CH); Dariusz Oliwiusz Palys, Aargau (CH)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 392 days.

(21) Appl. No.: 16/569,090

(22) Filed: Sep. 12, 2019

(65) Prior Publication Data

US 2021/0080106 A1 Mar. 18, 2021

(51) Int. Cl.

| | |
|---|---|
| ***F23R 3/00*** | (2006.01) |
| ***F23M 20/00*** | (2014.01) |
| ***F23R 3/06*** | (2006.01) |

(52) U.S. Cl.

CPC ..... *F23M 20/005* (2015.01); *F23R 3/002* (2013.01); *F23R 3/06* (2013.01); *F05B 2260/964* (2013.01); *F05D 2260/963* (2013.01); *F23R 2900/00014* (2013.01)

(58) Field of Classification Search

CPC .. F23R 3/002; F23R 3/06; F23R 2900/00014; F05D 2260/963; F23M 20/005

See application file for complete search history.

(56) References Cited

U.S. PATENT DOCUMENTS

| | | | |
|---|---|---|---|
| 3,791,692 | A | 2/1974 | Piere |
| 4,628,689 | A | 12/1986 | Jourdan |
| 5,290,973 | A | 3/1994 | Kwoh |
| 5,478,207 | A | 12/1995 | Stec |
| 5,522,705 | A | 6/1996 | Elaini et al. |
| 5,599,165 | A | 2/1997 | Elaini et al. |

(Continued)

FOREIGN PATENT DOCUMENTS

| | | | |
|---|---|---|---|
| DE | 19603979 | A1 | 8/1997 |
| EP | 702131 | A1 | 3/1996 |

(Continued)

OTHER PUBLICATIONS

PCT International Search Report and Written Opinion for Application PCT/US2020/050344 dated Nov. 19, 2020; 11 pp.

*Primary Examiner* — Gerald L Sung

*Assistant Examiner* — Rene D Ford

(74) *Attorney, Agent, or Firm* — Armstrong Teasdale LLP

(57) ABSTRACT

An acoustic damper for a rotary machine includes at least one wall, at least one inlet, at least one outlet, at least one separating wall, and at least one neck. The wall extends from the back side of a combustor front panel and defines a damping chamber. The inlet is defined within the wall and is oriented to channel a flow of air into the damping chamber. The outlet is defined within the back side of the front panel. The separating wall is oriented to separate the damping chamber into a first volume and a second volume. The first volume of the damping chamber is configured to damp an acoustic pressure oscillation at a first frequency. The second volume of the damping chamber is configured to damp the acoustic pressure oscillation at a second frequency. The neck extends through the separating wall and is axially offset from the outlet.

9 Claims, 6 Drawing Sheets

(56) References Cited

U.S. PATENT DOCUMENTS

| | | | | |
|---|---|---|---|---|
| 5,812,496 | A | 9/1998 | Peck | |
| 6,413,050 | B1 | 7/2002 | Shimovetz | |
| 6,581,722 | B2 | 6/2003 | Faulhaber et al. | |
| 6,682,219 | B2 | 1/2004 | Alam et al. | |
| 6,917,200 | B2 | 7/2005 | Drobnitzky | |
| 7,334,408 | B2 * | 2/2008 | Bethke | F23R 3/002 60/725 |
| 7,357,220 | B2 | 4/2008 | Horikou | |
| 7,931,117 | B2 | 4/2011 | Payot et al. | |
| 8,167,091 | B2 | 5/2012 | Alecu et al. | |
| 8,469,141 | B2 | 6/2013 | Wang et al. | |
| 8,499,893 | B2 | 8/2013 | Alecu et al. | |
| 8,657,067 | B1 | 2/2014 | Mathur | |
| 8,684,130 | B1 | 4/2014 | Bothien et al. | |
| 8,720,204 | B2 | 5/2014 | Schilp et al. | |
| 8,733,496 | B2 | 5/2014 | Ono et al. | |
| 9,316,156 | B2 | 4/2016 | Matsuyama et al. | |
| 9,334,804 | B2 | 5/2016 | Bothien et al. | |
| 9,835,333 | B2 * | 12/2017 | Antoniono | F23R 3/286 |
| 10,220,474 | B2 | 3/2019 | Theuer et al. | |
| 10,221,769 | B2 | 3/2019 | Imfeld et al. | |
| 11,156,164 | B2 | 10/2021 | Biagioli et al. | |
| 2001/0009207 | A1 | 7/2001 | Faulhaber et al. | |
| 2003/0190099 | A1 | 10/2003 | Alam et al. | |
| 2004/0126247 | A1 | 7/2004 | Broser et al. | |
| 2004/0196041 | A1 | 10/2004 | Drobnitzky | |
| 2005/0217930 | A1 | 10/2005 | Horikou | |
| 2006/0059913 | A1 | 3/2006 | Bethke et al. | |
| 2007/0012530 | A1 | 1/2007 | Garcia | |
| 2007/0181362 | A1 | 8/2007 | Champney et al. | |
| 2008/0236951 | A1 | 10/2008 | Alecu et al. | |
| 2010/0133037 | A1 | 6/2010 | Payot et al. | |
| 2012/0181113 | A1 | 7/2012 | Alecu et al. | |
| 2012/0198854 | A1 | 8/2012 | Schilp et al. | |
| 2012/0206500 | A1 | 8/2012 | Koprowski et al. | |
| 2013/0223989 | A1 | 8/2013 | Matsuyama et al. | |
| 2014/0069738 | A1 | 3/2014 | Bothien et al. | |
| 2014/0096537 | A1 | 4/2014 | McMahon | |
| 2014/0345284 | A1 | 11/2014 | Bothien et al. | |
| 2015/0047357 | A1 | 2/2015 | Schuermans et al. | |
| 2015/0096829 | A1 | 4/2015 | Bothien et al. | |
| 2015/0113990 | A1 | 4/2015 | Eroglu | |
| 2015/0113991 | A1 | 4/2015 | Tonon et al. | |
| 2015/0113992 | A1 | 4/2015 | Tonon et al. | |
| 2015/0247426 | A1 | 9/2015 | Genin et al. | |
| 2015/0315972 | A1 | 11/2015 | Lumbab et al. | |
| 2015/0377487 | A1 | 12/2015 | Tonon et al. | |
| 2016/0161118 | A1 * | 6/2016 | Tonon | F23M 20/005 60/772 |
| 2016/0169513 | A1 | 6/2016 | Sobol et al. | |
| 2018/0156461 | A1 | 6/2018 | Theuer et al. | |
| 2020/0370477 | A1 | 11/2020 | Biagioli et al. | |
| 2021/0140638 | A1 | 5/2021 | Bolanos et al. | |

FOREIGN PATENT DOCUMENTS

| | | | |
|---|---|---|---|
| EP | 1441108 | A2 | 7/2004 |
| EP | 843452 | B1 | 3/2005 |
| EP | 1236924 | B1 | 10/2005 |
| EP | 1582733 | A2 | 10/2005 |
| EP | 1605209 | A1 | 12/2005 |
| EP | 1975379 | A2 | 10/2008 |
| EP | 2642204 | A1 | 9/2013 |
| EP | 2690365 | A1 | 1/2014 |
| EP | 2693121 | A1 | 2/2014 |
| EP | 2711922 | A2 | 3/2014 |
| EP | 2762784 | A1 | 8/2014 |
| EP | 2816289 | A1 | 12/2014 |
| EP | 2818670 | A1 | 12/2014 |
| EP | 2837782 | A1 | 2/2015 |
| EP | 2837783 | A1 | 2/2015 |
| EP | 2860449 | A1 | 4/2015 |
| EP | 2865947 | A1 | 4/2015 |
| EP | 2865948 | A1 | 4/2015 |
| EP | 2913589 | A1 | 9/2015 |
| EP | 2930429 | A1 | 10/2015 |
| EP | 2963345 | A1 | 1/2016 |
| EP | 3029377 | A1 | 6/2016 |
| EP | 3032177 | A1 | 6/2016 |
| WO | 2008050028 | A2 | 5/2008 |
| WO | 2008116291 | A | 10/2008 |
| WO | 2012127959 | A1 | 9/2012 |
| WO | 2013125683 | A1 | 8/2013 |
| WO | 2013169788 | A2 | 11/2013 |
| WO | 2014011268 | A2 | 1/2014 |
| WO | 2015185320 | A1 | 12/2015 |

* cited by examiner

SYSTEM AND METHOD FOR ACOUSTIC DAMPERS WITH MULTIPLE VOLUMES IN A COMBUSTION CHAMBER FRONT PANEL

BACKGROUND

The field of the disclosure relates generally to gas turbine engines and, more particularly, to Helmholtz dampers used to damp combustion instabilities within gas turbine engines.

Gas turbine engines typically include at least one compressor, at least one combustor, and at least one turbine arranged in a serial flow configuration. Typically, the compressor channels compressed air to the combustor where it is mixed with a flow of fuel and combusted, creating a high temperature flow of combustion gas that is channeled to the turbine. However, combustion within at least some combustors may be unstable. Specifically, the heat released during combustion, when combined with the increased pressure caused by combustion, flow disturbances and the acoustics of the system, may cause acoustic pressure oscillations to develop within the combustor.

Within known combustors, the acoustic pressure oscillations typically occur during normal operating conditions and may depend on a fuel-to-air stoichiometry within the combustor, a total mass flow within the combustor, and/or other operating conditions. Over time, the acoustic pressure oscillations may cause equipment damage or other operational problems. To facilitate removing the effect of the pressure oscillation, at least some combustors include at least one acoustic damper, which can take the form of a quarter wave tube, a Helmholtz damper or a perforated screen, that absorbs the acoustic pressure oscillations reducing their amplitude. The acoustic pressure oscillations may have a plurality of frequencies. However, the volume and neck dimensions of Helmholtz dampers are designed to damp acoustic pressure oscillations at one target frequency, and, as such, two different acoustic dampers are required to damp acoustic pressure oscillations featuring two frequencies.

BRIEF DESCRIPTION

In one aspect, an acoustic damper for a rotary machine is provided. The acoustic damper includes at least one wall, at least one inlet, at least one outlet, at least one separating wall, and at least one neck. The wall extends from the back side of a combustor front panel and at least partially defines a damping chamber. The inlet is defined within the wall and is oriented to channel a flow of air into the damping chamber. The outlet is defined through the front panel and is oriented to channel the flow of air from the damping chamber. The outlet being in fluid communication with a cylindrical conduit extending from the back side of the front panel. The separating wall is within the damping chamber and is oriented to separate the damping chamber into a first volume and a second volume. The first volume of the damping chamber being configured to damp an acoustic pressure oscillation at a first frequency. The second volume of the damping chamber being configured to damp the acoustic pressure oscillation at a second frequency. The neck extends through the separating wall and is axially offset from the outlet.

In another aspect, a method of manufacturing an acoustic damper on a front panel of a combustor is provided. The method includes defining an outlet through the front panel, the outlet extending from a front side of the front panel to a back side of the front panel. The outlet being in fluid communication with a cylindrical conduit extending from the back side of the front panel. The method also includes forming at least one wall on the back side of the front panel. The at least one wall and the back side of the front panel define a damping chamber. The method further includes defining at least one inlet within the at least one wall. The method also includes forming at least one separating wall within the damping chamber. The separating wall being configured to separate the damping chamber into a first volume and a second volume. The first volume being configured to damp an acoustic pressure oscillation at a first frequency. The second volume being configured to damp the acoustic pressure oscillation at a second frequency. The method further includes forming at least one neck extending through the separating wall. The neck extends through the separating wall and is axially offset from the outlet.

In yet another aspect, a rotary machine is provided. The rotary machine includes at least one combustor including a front panel having a front side and an opposing back side and at least one acoustic damper positioned on the back side of the front panel. The acoustic damper includes at least one wall, at least one inlet, at least one outlet, at least one separating wall, and at least one neck. The wall extends from the back side of a combustor front panel and at least partially defines a damping chamber. The inlet is defined within the wall and is oriented to channel a flow of air into the damping chamber. The outlet is defined through the front panel and is oriented to channel the flow of air from the damping chamber. The outlet being in fluid communication with a cylindrical conduit extending from the back side of the front panel. The separating wall is within the damping chamber and is oriented to separate the damping chamber into a first volume and a second volume. The first volume of the damping chamber is configured to damp an acoustic pressure oscillation at a first frequency. The second volume of the damping chamber is configured to damp the acoustic pressure oscillation at a second frequency. The neck extends through the separating wall and is axially offset from the outlet.

DETAILED DESCRIPTION

Figure 1:
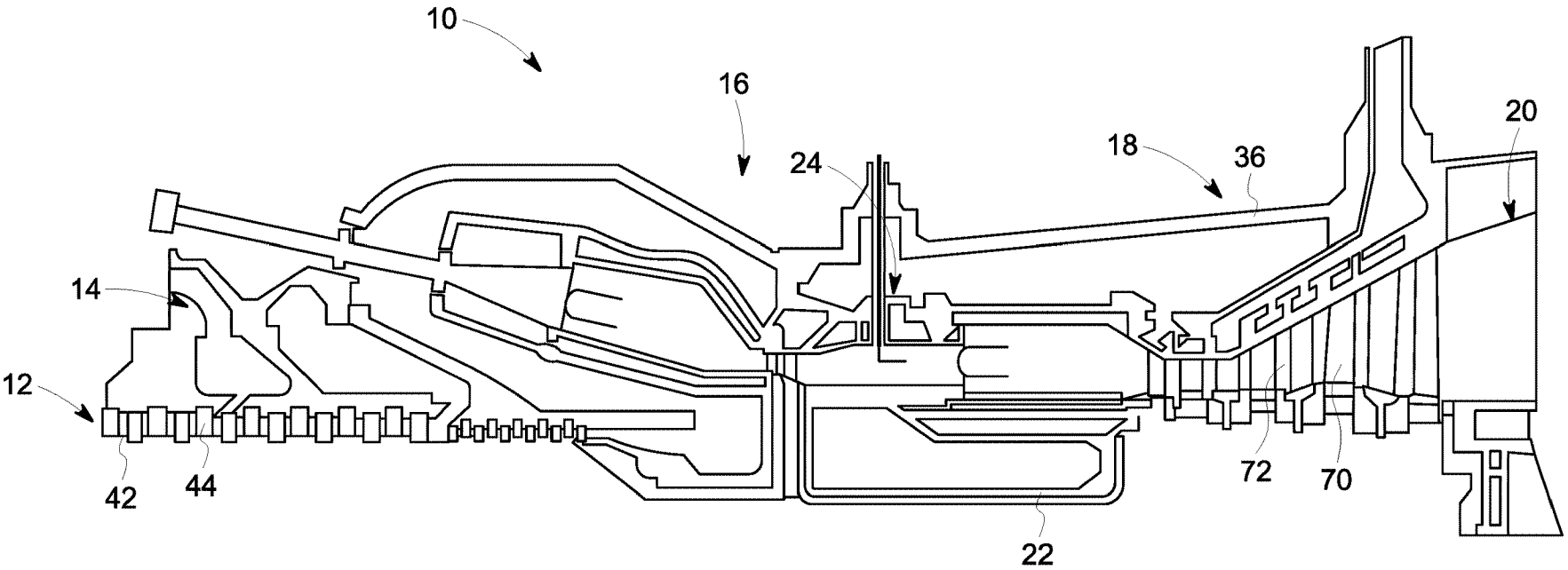
FIG. 1 is a simplified cross-sectional view of a portion of an exemplary rotary machine.

Exemplary embodiments of acoustic dampers with multiple volumes and methods described herein facilitate damping a plurality of acoustic pressure oscillations at multiple frequencies, reducing acoustic oscillations within a combustor, and reducing the number of acoustic dampers required to damp acoustic pressure oscillations. The exemplary acoustic dampers described herein include at least one wall extending from a back side of a front panel of a combustor. The wall and the back side of the front panel define a damping chamber. The back side of the front panel defines at least one outlet, and the wall defines at least one inlet. The inlet is oriented to channel a flow of air into the damping chamber, and the outlet is oriented to channel the flow of air out of the damping chamber. The damper also includes at least one separating wall that separates the damping chamber into a first volume and a second volume. At least one neck extends through the separating wall. During operations, the outlet of the acoustic damper enables passage of acoustic oscillations into the first volume, and the neck enables passage of acoustic oscillations into the second volume from the first volume. The first volume damps a first acoustic pressure oscillation at a first frequency, and the second volume damps a second acoustic pressure oscillation at a second frequency. Appropriately coupled together, these two volumes may damp a wider range of frequencies than if they were two independent Helmholtz dampers. As such, the acoustic dampers described herein damp the acoustic pressure oscillations at multiple frequencies and facilitate reducing damage to the combustor. Additionally, because the acoustic dampers described herein damp the acoustic pressure oscillations at multiple frequencies, fewer acoustic dampers are required to damp the acoustic pressure oscillations.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be identified. Such ranges may be combined and/or interchanged, and include all the subranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

FIG. 1 is a schematic view of an exemplary rotary machine 10 with which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any machine having rotor blades for which the embodiments of the current disclosure are enabled to function as described herein. In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, compressed air is mixed with fuel and ignited in sequential, axially spaced combustion zones to generate combustion gases that are channeled towards turbine section 18. More specifically, combustor section 16 includes at least one burner 24 (for example, a sequential environmental, or SEV, burner), in which a fuel (for example, natural gas and/or fuel oil) is injected into the air flow, and the fuel-air mixture is ignited to generate high temperature combustion gases that are channeled towards turbine section 18.

Turbine section 18 converts thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20.

Figure 2:
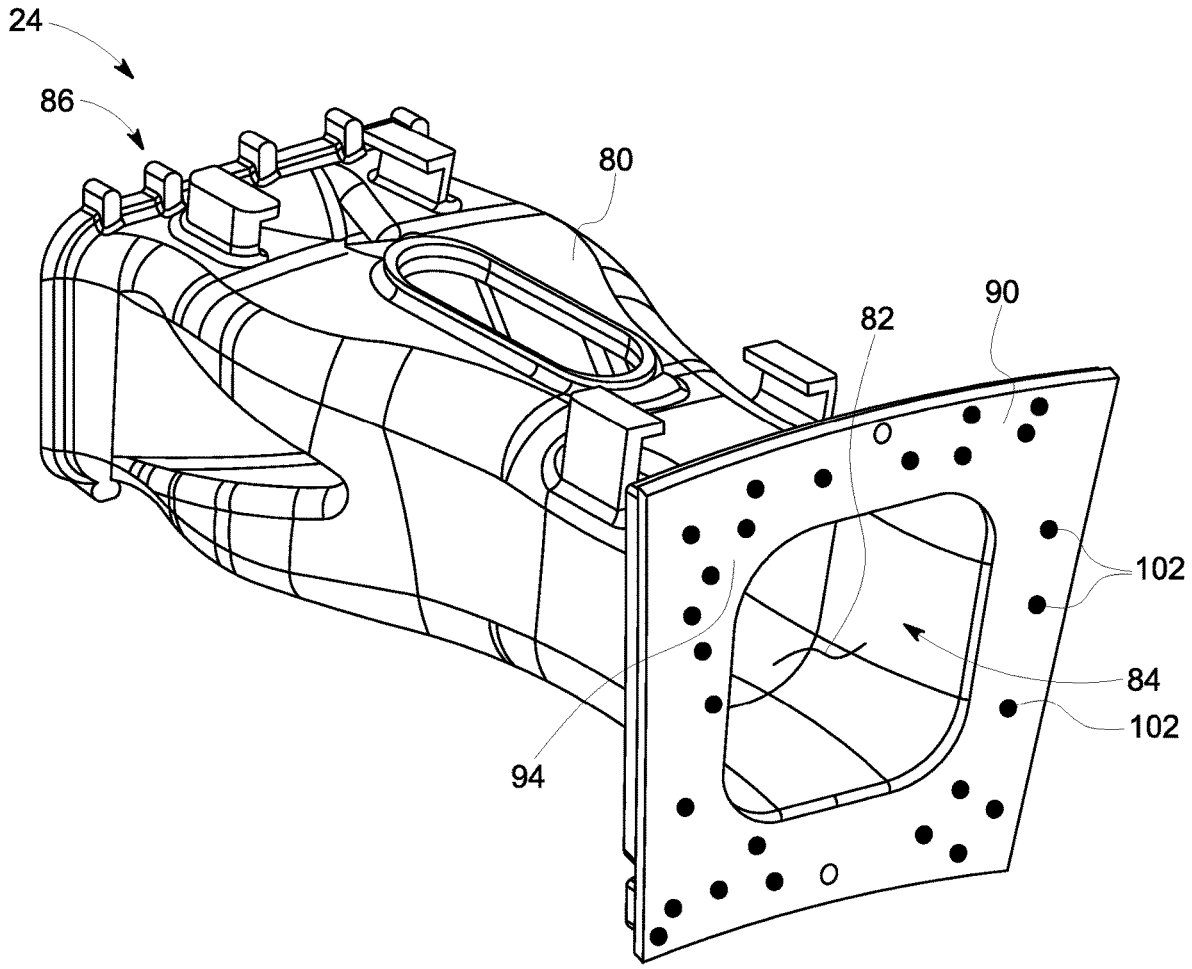
FIG. 2 is a perspective view of an exemplary burner positioned with a combustor section of the rotary machine shown in FIG. 1.
Figure 3:
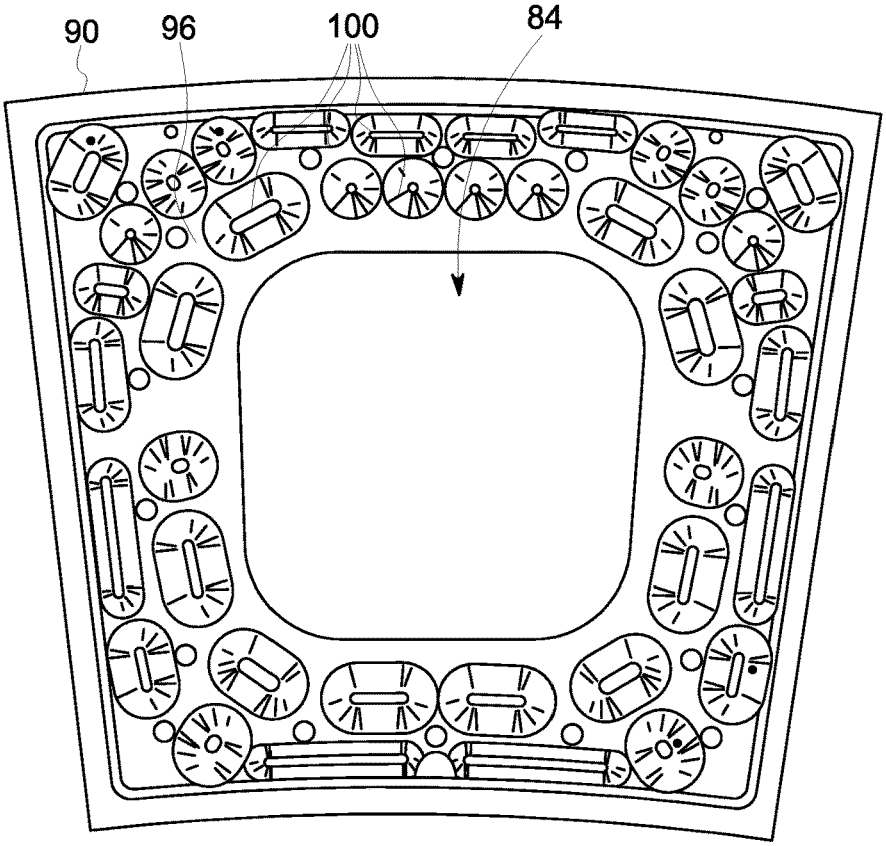
FIG. 3 is a rear view of an exemplary front panel that may be positioned within the burner shown in FIG. 2.

FIG. 2 is a perspective view of burner 24 positioned within combustor section 16 and including an exemplary front panel 90. FIG. 3 is a rear view of front panel 90 positioned within burner 24. Burner 24 includes at least one burner wall 80 that defines a burner chamber 82. A combustor duct (not shown) is coupled to front panel 90 and is configured to receive combustion gases from burner 24. Front panel 90 defines a burner outlet 84. Front panel 90 has a front side 94 and a back side 96 that is opposite front side 94. Front panel 90 is positioned on burner 24 such that back side 96 is coupled to burner 24, and front side 94 is oriented away from burner 24. As shown in FIG. 3, a plurality of acoustic dampers 100 extends in an axial direction from back side 96 of front panel 90. In the exemplary embodiment, about thirty to about forty acoustic dampers 100 are positioned on back side 96 of front panel 90. However, any number of acoustic dampers 100 that enable burner 24 to operate as described herein may be positioned on back side 96 of front panel 90. Front panel 90 defines a plurality of outlets 102 (damper necks) that extend through front panel 90 from back side 96 to front side 94.

During operations, the flow of compressed air from compressor section 14 is channeled into burner 24. A flow of fuel is injected into the flow of compressed air and the mixture of compressed air and fuel is ignited. Combustion within burner 24 may be unstable. Specifically, heat released during combustion, when combined with the increased pressure caused by combustion, flow disturbances and the acoustics of the system, may cause acoustic pressure oscillations within burner 24 and the combustion chamber. The acoustic pressure oscillations generally occur during normal operating conditions and may depend on a fuel-to-air stoichiometry within burner 24, a total mass flow within burner 24, and/or other operating conditions. The acoustic pressure oscillations may cause equipment damage or other operational problems. However, acoustic dampers 100 facilitate absorbing the acoustic pressure oscillations by reducing the amplitude of the pressure oscillations. Specifically, outlets 102 enable the acoustic coupling between the combustion chamber and acoustic dampers 100, leading to the damping of the acoustic pressure oscillations.

Figure 4:
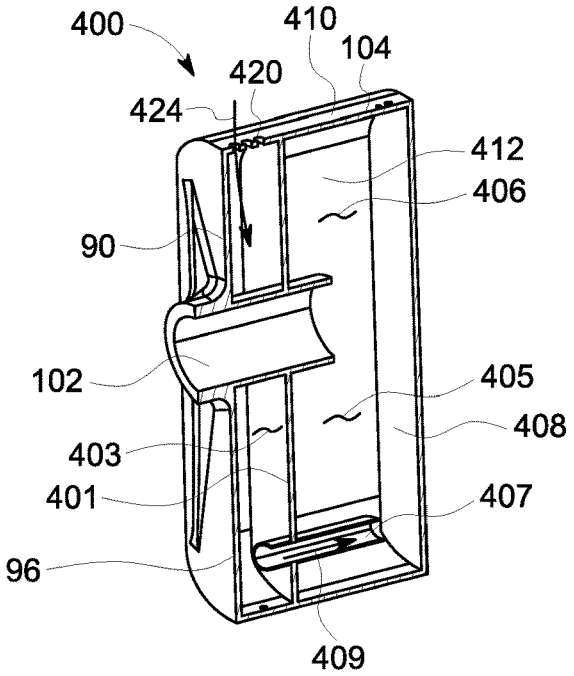
FIG. 4 is a perspective cutaway view of an acoustic damper, as may be positioned on a back side of the front panel shown in FIG. 3.

FIG. 4 is a perspective sectional view of an exemplary acoustic damper 400. In the exemplary embodiment, acoustic damper 400 includes at least one wall 104 that at least partially defines a damping chamber 406. In the illustrated embodiment, acoustic damper 400 also includes a top 408. Top 408 and back side 96 also define a portion of damping chamber 406. In the illustrated embodiment, wall 104 is generally elliptical and extends substantially perpendicularly from back side 96. Specifically, in the illustrated embodiment, wall 104 includes two semicircular arcs 410 and two straight portions 412 that extend substantially perpendicularly from back side 96. Straight portions 412 are coupled to semicircular arcs 410 such that a continuous wall 104 is formed. Top 408 and back side 96 are substantially planar and positioned proximate semicircular arcs 410 and straight portions 412 such that top 408 and back side 96 are oriented substantially parallel to each other. Top 408 is positioned in contact with semicircular arcs 410 and straight portions 412, such that, in the illustrated embodiment, semicircular arcs 410, straight portions 412, top 408, and back side 96 cooperate to define damping chamber 406. However, acoustic damper 400 and damping chamber 406 may have any other shape that enables acoustic damper 400 to function as described herein. Specifically, the shape of acoustic damper 100 and damping chamber 406 may be determined to fulfill mechanical design and manufacturing constraints and to optimize the air flow characteristics in the damper.

Additionally, acoustic damper 400 also includes at least one separating wall 401 within damping chamber 406. Separating wall 401 separates damping chamber 406 into a first volume 403 and a second volume 405. First volume 403 damps a first acoustic pressure oscillation at a first frequency, and second volume 405 damps a second acoustic pressure oscillation at a second frequency. Acoustic damper 400 further includes a neck 407 that channels a flow of air, as indicated by arrow 409, from first volume 403 to second volume 405 within damping chamber 406. In the exemplary embodiment, neck 407 is a tube extending through separating wall 401 with a length that is determined based on the frequencies of the acoustic pressure oscillations targeted for damping. In alternative embodiments, neck 407 may be a hole through separating wall 401 provided that a thickness of separating wall 401 is the same as the length of neck 407. In the exemplary embodiment, first volume 403 is about 100 cubic centimeters ($cm^3$) to about 200 $cm^3$. Second volume 405 is about 300 $cm^3$ to about 400 $cm^3$, and target frequencies lie within the range from about 100 Hz to about 400 HZ.

As shown in FIG. 4, an outlet 102 extends through front panel 90 from front side 94 to back side 96 (not shown in FIG. 4) to enable acoustic coupling with damping chamber 406. Outlet 102 is axially and radially offset from neck 407. The acoustic pressure oscillations are damped by first volume 403 and/or second volume 405. In the exemplary embodiment, outlet 102 is a cylindrical conduit that extends through front panel 90 and separating wall 401. However, outlet 102 may have any other shape that enables acoustic damper 400 to function as described herein. Specifically, the shape of outlet 102 may be determined by CFD analysis and may be optimized based on mechanical and manufacturing constraints, the total mass flow within the damper, and/or any other operating condition. Additionally, although the illustrated embodiment shows only a single outlet 102 for each acoustic damper 400, acoustic damper 400 may include any number of outlets 102 that enables acoustic damper 400 to operate as described herein. Specifically, the number of outlets 102 included with each acoustic damper 400 may be determined by CFD analysis and may be changed based on cooling constraints, mechanical design constraints, the total mass flow within the damper, and/or any other operating condition.

Wall 104 defines at least one inlet 420. More specifically, in the exemplary embodiment, wall 104 defines a plurality of inlets 420. Inlets 420 channel a flow of air, as indicated by arrow 424, into damping chamber 406. Specifically, inlets 420 channel flow of air 424 into first volume 403 of damping chamber 406. Acoustic damper 400 may include any number of inlets 420 that enables acoustic damper 400 to operate as described herein. Specifically, the number of inlets 420 included with each acoustic damper 400 may be determined by CFD analysis and may be changed based on a desired pressure ratio, the total mass flow through the damper, mechanical design constraints, and/or any other operating condition. In the exemplary embodiment, the source of flow of air 424 is compressor section 14, and flow of air 424 typically has a higher pressure than the combustion gases such that flow of air 424 is channeled out of acoustic damper 400 through outlet 102. As such, inlets 420 channel air 424 into first volume 403 of damping chamber 406, neck 407 channels air 409 from first volume 403 to second volume 405, and outlet 102 channels air from second volume 405 of damping chamber 406 to the combustion chamber.

During operations, burner 24 ignites the fuel-air mixture and generates high temperature combustion gases that are channeled towards turbine section 18. Heat released during combustion, when combined with the increased pressure created during combustion, flow disturbances and the acoustics of the system, may cause acoustic pressure oscillations to develop within burner 24. The acoustic pressure oscillations in the combustion chamber in front of outlet 102 make the volume of air in second volume 405 oscillate. The oscillations in second volume 405 may generate oscillations in first volume 403 through neck 407. More specifically, first volume 403 damps the first acoustic pressure oscillation at first frequency, and second volume 405 damps the second acoustic pressure oscillation at second frequency. When coupled together, volumes 405 and 403 may damp a wide range of frequencies around the target frequencies of each volume. As such, acoustic damper 400 damps a wide range of frequencies around two frequencies of the acoustic pressure oscillations. Accordingly, the number of acoustic dampers required to damp the acoustic pressure oscillations is reduced because acoustic damper 400 damps the acoustic pressure oscillations at the first and second frequencies.

Figure 5:
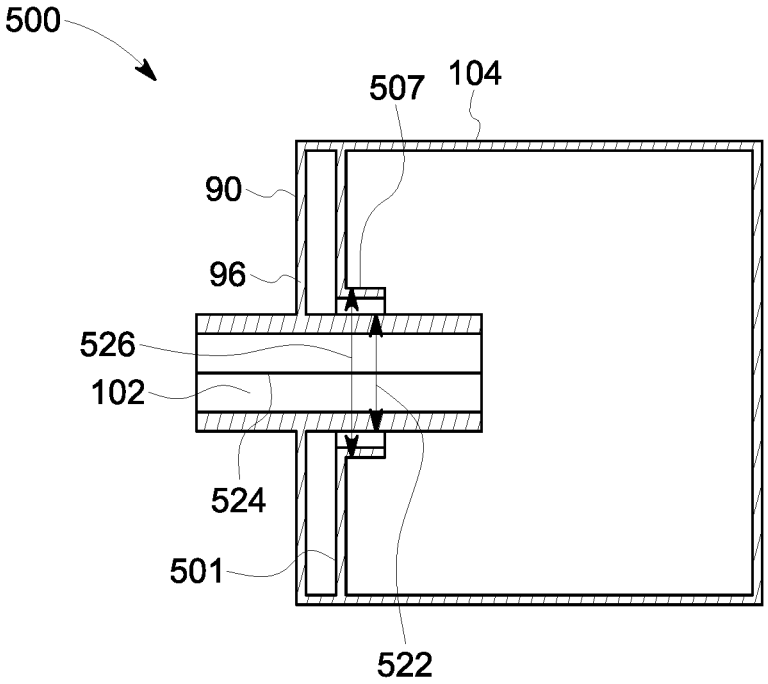
FIG. 5 is a side cutaway view of another acoustic damper, as may be positioned on a back side of the front panel shown in FIG. 3.

FIG. 5 is a cutaway side view of an exemplary acoustic damper 500. Acoustic damper 500 is substantially similar to acoustic damper 400 except for the arrangement of a neck 507 relative to outlet 102. As such, inlets through wall 104 are not shown in FIG. 5.

As shown in FIG. 4, neck 407 and outlet 102 are axially and radially separated such that neck 407 and outlet 102 do not occupy the same volume within damping chamber 406. In contrast, as shown in FIG. 5, neck 507 and outlet 102 are located coaxially with each other such that outlet 102 is positioned within neck 507 and occupies a portion of neck 507. Specifically, outlet 102 is a cylindrical conduit extending through front panel 90 and a separating wall 501 and having an outlet diameter 522 and a central axis 524. Neck 507 is also a cylindrical conduit extending through separating wall 501 and having a neck diameter 526. Neck 507 shares central axis 524 with outlet 102 such that neck 507 and outlet 102 are located coaxially with each other. Neck diameter 526 is larger than outlet diameter 522 such that neck 507 circumscribes outlet 102. When comparing the dampers 400, 500 shown in FIGS. 4 and 5, respectively, wall 104 of acoustic damper 500 is taller than wall 104 of acoustic damper 400, and back side 96 of acoustic damper 500 occupies less area than back side 96 of acoustic damper 400. As such, more acoustic dampers 500 can be coupled to front panel 90 than acoustic dampers 400. Accordingly, if more acoustic dampers are required, acoustic damper 500 may be used rather than acoustic damper 400.

Figure 6:
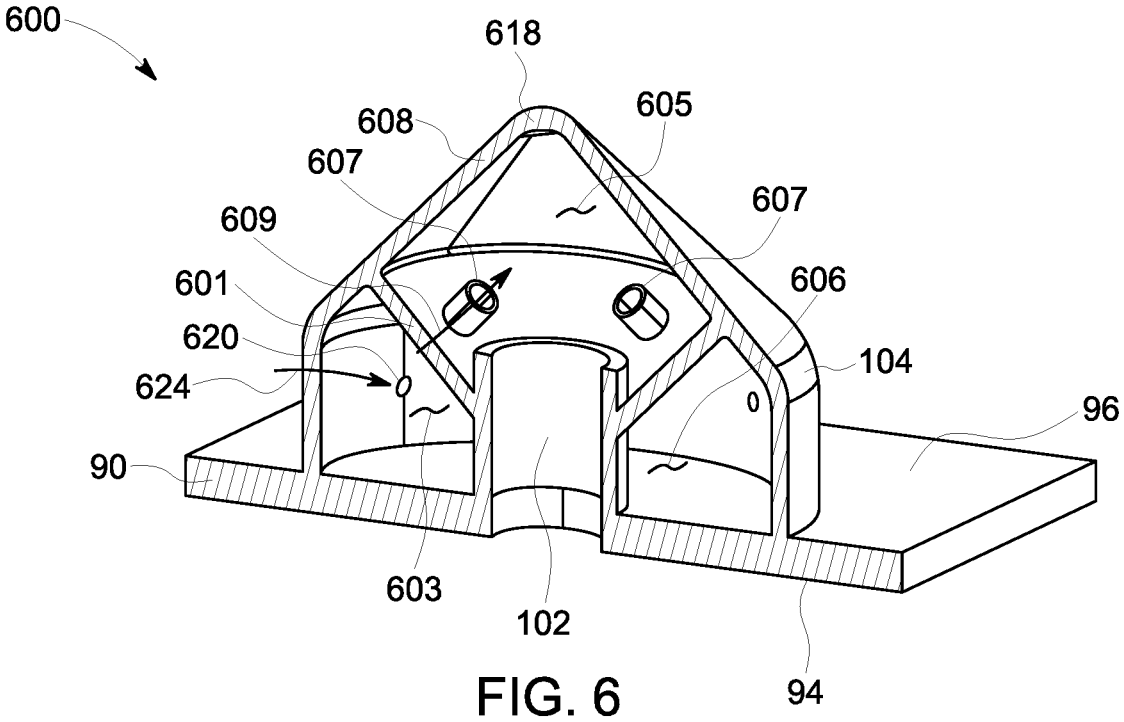
FIG. 6 is a perspective cutaway view of another acoustic damper, as may be positioned on a back side of the front panel shown in FIG. 3.

FIG. 6 is a perspective cutaway view of an exemplary acoustic damper 600 positioned on back side 96 of front panel 90. Acoustic damper 600 includes at least one wall 104, and wall 104 and back side 96 of front panel 90 define a damping chamber 606. In the exemplary embodiment, acoustic damper 600 also includes a top 608. Wall 104, top 608, and back side 96 of front panel 90 define damping chamber 606. In the illustrated embodiment, wall 104 is substantially circular and extends substantially perpendicularly from back side 96. Top 608 has a substantially conical shape and extends perpendicularly from wall 104 to form an apex 618. However, acoustic damper 600 and damping chamber 606 may have any shape that enables acoustic damper 600 to operate as described herein. Specifically, the shape of acoustic damper 600 and damping chamber 606 may be optimized based on mechanical and manufacturing constraints, the air flow features through the damper and/or any other operating condition.

Additionally, acoustic damper 600 also includes at least one separating wall 601 within damping chamber 606. Separating wall 601 separates damping chamber 606 into a first volume 603 and a second volume 605. First volume 603 damps a first acoustic pressure oscillation at a first frequency, and second volume 605 damps a second acoustic pressure oscillation at a second frequency. Acoustic damper 600 further includes at least one neck 607 that channels a flow of air, as indicated by arrow 609, from first volume 603 to second volume 605 within damping chamber 606. In the exemplary embodiment, acoustic damper 600 includes a plurality of necks 607. Acoustic damper 600 may include any number of necks 607 that enables acoustic damper 600 to operate as described herein, including, without limitation, one, two, three, or more necks 607. In the exemplary embodiment, necks 607 are axially offset from outlet 102.

As shown in FIG. 6, an outlet 102 extends through front panel 90 from front side 94 to back side 96 to enable acoustic pressure oscillations to enter damping chamber 606. The acoustic pressure oscillations are damped in first volume 603 and/or second volume 605. In the exemplary embodiment, outlet 102 is a cylindrical conduit that extends through front panel 90 and separating wall 601. However, outlet 102 may have any other shape that that enables acoustic damper 600 to function as described herein. Specifically, the shape of outlet 102 may be determined by CFD analysis and may be changed based on mechanical and manufacturing constraints, the total mass flow within the damper, and/or any other operating condition. Additionally, although the illustrated embodiment shows only a single outlet 102 for each acoustic damper 600, acoustic damper 600 may include any number of outlets 102 that enables acoustic damper 600 to operate as described herein. Specifically, the number of outlets 102 included with each acoustic damper 600 may be determined by CFD analysis and may be optimized based on cooling constraints, mechanical design constraints, the total mass flow within the damper, and/or any other operating condition.

Wall 104 defines at least one inlet 620. More specifically, in the exemplary embodiment, wall 104 defines a plurality of inlets 620. Inlets 620 channel a flow of air, as indicated by arrow 624, into damping chamber 606. Specifically, inlets 620 channel flow of air 624 into first volume 603 of damping chamber 606. Acoustic damper 600 may include any number of inlets 620 that enables acoustic damper 600 to operate as described herein. Specifically, the number of inlets 620 included with each acoustic damper 600 may be determined by CFD analysis and may be optimized based on a desired pressure ratio, the total mass flow through the damper, mechanical design constraints, and/or any other operating condition. In the exemplary embodiment, the source of flow of air 624 is compressor section 14, and flow of air 624 typically has a higher pressure than the combustion gases such that flow of air 624 is channeled out of acoustic damper 600 through outlet 102. As such, inlets 620 channel air 624 into first volume 603 of damping chamber 606, neck 607 channels air 609 from first volume 603 to second volume 605, and outlet 102 channels air from second volume 605 of damping chamber 606 to the combustion chamber.

During operations, burner 24 ignites the fuel-air mixture and generates high temperature combustion gases that are channeled towards turbine section 18. Heat released during combustion, when combined with the increased pressure created during combustion, flow disturbances and the acoustics of the system, may cause acoustic pressure oscillations to develop within burner 24. The acoustic pressure oscillations in the combustion chamber in front of outlet 102 make the volume of air in second volume 605 oscillate. The oscillations in second volume 605 may generate oscillations in first volume 603 through neck 607. More specifically, first volume 603 damps the first acoustic pressure oscillation at first frequency, and second volume 605 damps the second acoustic pressure oscillation at second frequency. When coupled together, volumes 605 and 603 may damp a wide range of frequencies around the target frequencies of each volume. As such, acoustic damper 600 damps a wide range of frequencies around two frequencies of the acoustic pressure oscillations. Accordingly, the number of acoustic dampers required to damp the acoustic pressure oscillations is reduced because acoustic damper 600 damps the acoustic pressure oscillations at the first and second frequencies.

Figure 7:
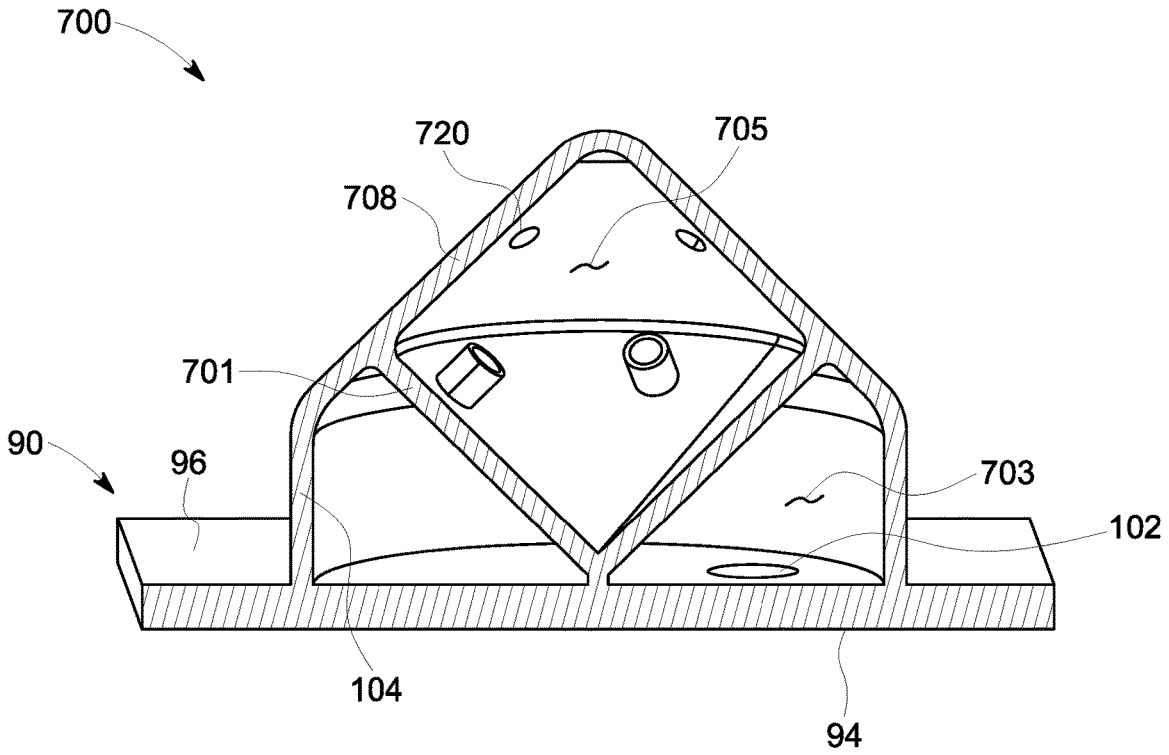
FIG. 7 is a side cutaway view of another acoustic damper, as may be positioned on a back side of the front panel shown in FIG. 3.

FIG. 7 is a cutaway perspective view of an exemplary acoustic damper 700. Acoustic damper 700 is substantially similar to acoustic damper 600 except for the arrangement of outlet 102 relative to a separating wall 701 and the position of a plurality of inlets 720. As shown in FIG. 6, outlet 102 extends through front panel 90 from front side 94 to back side 96 and through separating wall 601, and inlets 620 extend through wall 104. In contrast, as shown in FIG. 7, outlet 102 extends only through front panel 90 from front side 94 to back side 96, and inlets 720 extend through a top 708. Specifically, outlet 102 does not extend through separating wall 701, and inlets 720 extend through top 708 into a second volume 705 rather than into a first volume 703. This is again another design example that achieves the same purpose as the embodiment shown in FIG. 6.

Figure 8:
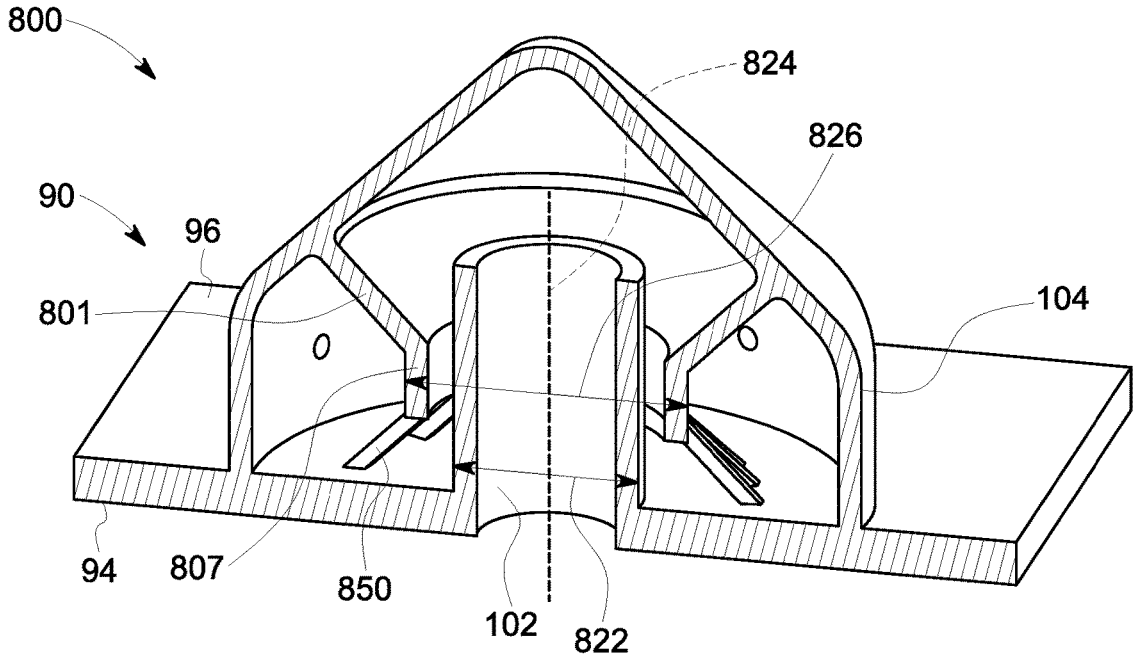
FIG. 8 is a perspective cutaway view of another acoustic damper, as may be positioned on a back side of the front panel shown in FIG. 3.

FIG. 8 is a cutaway perspective view of an exemplary acoustic damper 800. Acoustic damper 800 is substantially similar to acoustic damper 600 except for the arrangement of a neck 807 relative to outlet 102. As shown in FIG. 6, necks 607 and outlet 102 are separated such that necks 607 and outlet 102 do not occupy the same volume within damping chamber 606. In contrast, as shown in FIG. 8, neck 807 and outlet 102 are located coaxially with each other such that outlet 102 is positioned within neck 807 and occupies a portion of neck 807. Specifically, outlet 102 is a cylindrical conduit extending through front panel 90 and a separating wall 801 and having an outlet diameter 822 and a central axis 824. Neck 807 is also a cylindrical conduit extending through separating wall 801 and having a neck diameter 826. Neck 507 shares central axis 524 with outlet 102 such that neck 507 and outlet 102 are located coaxially with each other. Neck diameter 826 is larger than outlet diameter 822 such that neck 807 circumscribes at least a portion of outlet 102. Additionally, as shown in FIG. 6, acoustic damper 600 includes a plurality of necks 607 while acoustic damper 800 includes a single neck 807. Moreover, as shown in FIG. 8, acoustic damper 800 includes a plurality of supports 850 attached to neck 807 and back side 96 of front panel 90 and configured to support neck 807 and separating wall 801 to enable additive manufacturing of this part. Supports 850 are attached to neck 807 and back side 96 of front panel 90 such that supports 850 circumscribe outlet 102. This is again another design example that achieves the same purpose as the embodiment shown in FIG. 6.

Figure 9:
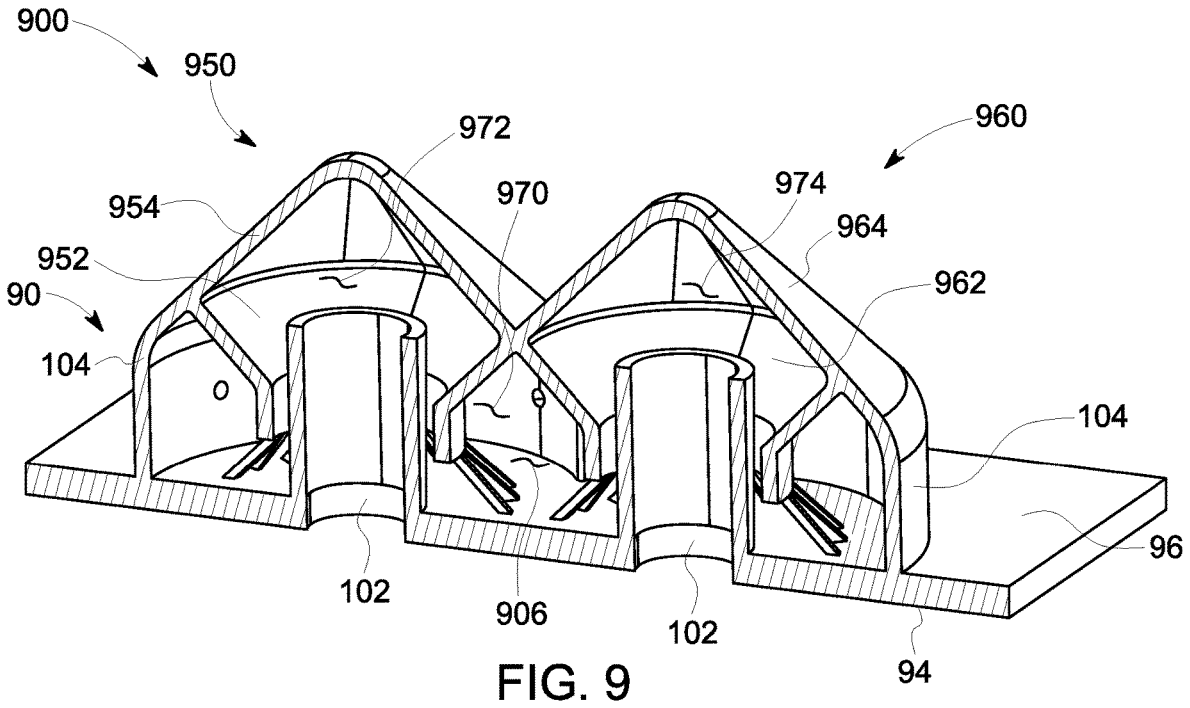
FIG. 9 is a perspective cutaway view of another acoustic damper, as may be positioned on a back side of the front panel shown in FIG. 3.

FIG. 9 is a cutaway perspective view of an exemplary acoustic damper 900. Acoustic damper 900 is a multi-volume acoustic damper including two acoustic dampers 800 coupled together to form a single acoustic damper 900. More specifically, acoustic damper 900 includes a first acoustic damper 950 and a second acoustic damper 960 coupled together such that first acoustic damper 950 and second acoustic damper 960 define a single damping chamber 906. Specifically, wall 104 of first acoustic damper 950 intersects wall 104 of second acoustic damper 960 such that damping chamber 906 is defined. More specifically, first acoustic damper 950 includes a first separating wall 952, and second acoustic damper 960 includes a second separating wall 962. Walls 104, first separating wall 952, and second separating wall 962 define a first volume 970 of acoustic damper 900 which is shared between first acoustic damper 950 and second acoustic damper 960. First acoustic damper 950 includes a first top 954, and second acoustic damper 960 includes a second top 964. First separating wall 952 and first top 954 define a second volume 972, and second separating wall 962 and second top 964 define a third volume 974. As such, acoustic damper 900 damps multiple frequencies of the acoustic pressure oscillations. Because acoustic damper 900 is able to damp the acoustic pressure oscillations at different frequencies, the number of acoustic dampers required to damp the acoustic pressure oscillations is reduced.

Figure 10:
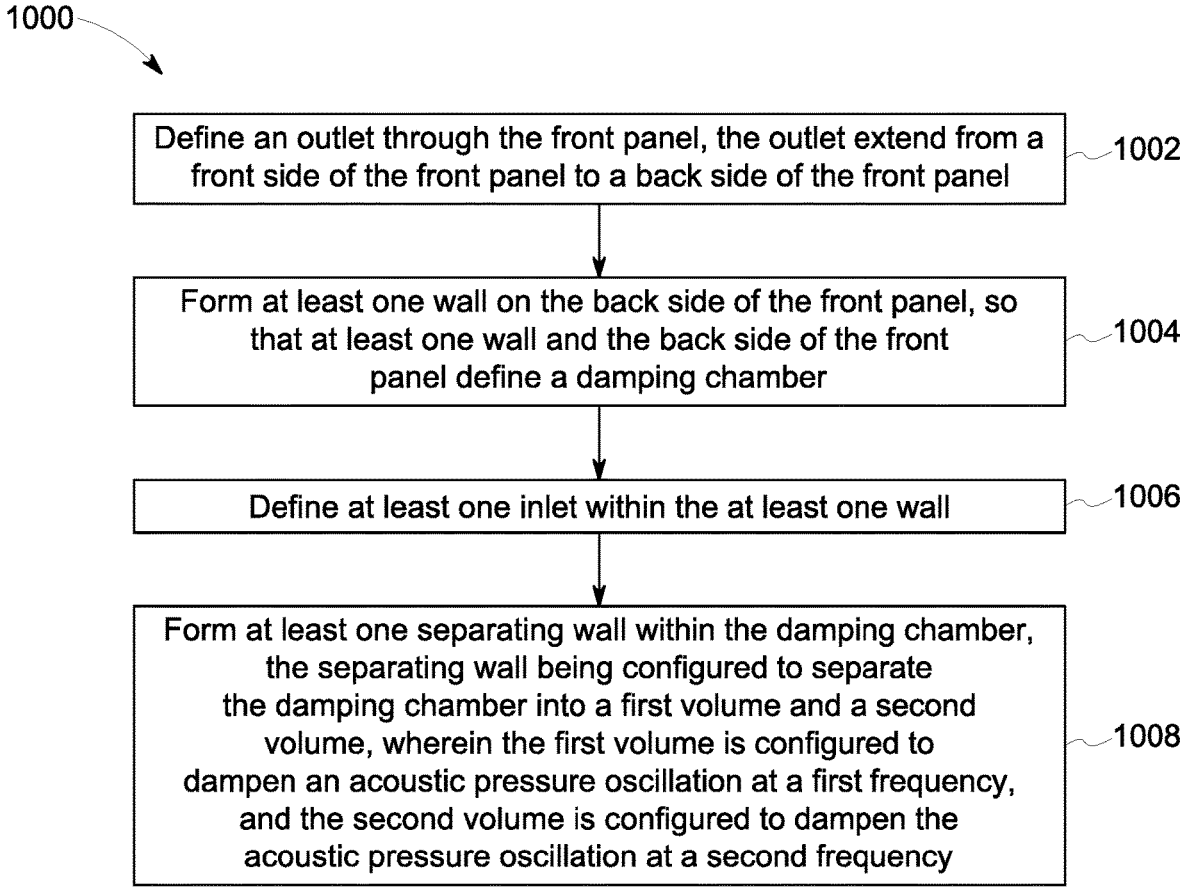
FIG. 10 is a flow diagram of an exemplary embodiment of a method of reducing acoustic oscillations within the rotary machine shown in FIG. 1.

FIG. 10 is a flow diagram of an exemplary embodiment of a method 1000 of manufacturing acoustic dampers 400, 500, 600, 700, 800, and 900. The method 1000 includes defining 1002 an outlet, such as outlet 102, through front panel 90. Outlet 102 extends from front side 94 of front panel 90 to back side 96 of front panel 90. Method 1000 also includes forming 1004 at least one wall, such as wall 104, on back side 96 of front panel 90. Wall 104 may include a top (e.g., top 608). Wall 104 and back side 96 of front panel 90 define damping chamber 406. Method 1000 further includes defining 1006 at least one inlet, such as inlet 420, within wall 104. Method 1000 also includes forming 1008 at least one separating wall, such as separating wall 401, within damping chamber 406. Separating wall 401 is configured to separate damping chamber 406 into a first volume 403 and a second volume 405.

Acoustic dampers 400, 500, 600, 700, 800, and 900 described herein may be manufactured using any manufacturing technique that enables acoustic dampers 400, 500, 600, 700, 800, and 900 to operate as described herein. In the exemplary embodiment, acoustic dampers 400, 500, 600, 700, 800, and 900 are manufactured by additively manufacturing acoustic dampers 400, 500, 600, 700, 800, and 900 and front panel 90. Specifically, front panel 90 is additively manufactured to define outlets 102 within front panel 90. Acoustic dampers 400, 500, 600, 700, 800, and 900 are then additively manufactured on back side 96 of front panel 90. Additively manufacturing reduces the cost and time to form acoustic dampers 400, 500, 600, 700, 800, and 900. As such, additively manufacturing acoustic dampers 400, 500, 600, 700, 800, and 900 reduces the cost and manufacturing time to produce acoustic dampers 400, 500, 600, 700, 800, and 900 while increasing the reliability of burner 24 and rotary machine 10. Additionally, additively manufacturing acoustic dampers 400, 500, 600, 700, 800, and 900 enables a shape and/or volume of acoustic dampers 400, 500, 600, 700, 800, and 900 to be easily optimized without substantially redesigning the manufacturing process. Accordingly, additively manufacturing acoustic dampers 400, 500, 600, 700, 800, and 900 provides flexibility in the manufacturing process.

In the exemplary embodiment, acoustic dampers 400, 500, 600, 700, 800, and 900 are mounted to, or formed integrally with, back side 96 of front panel 90. In alternative embodiment, acoustic dampers 400, 500, 600, 700, 800, and 900 may be mounted at any location within rotary machine 10 that enables rotary machine 10 to operate as described herein. For example, acoustic dampers 400, 500, 600, 700, 800, and 900 may be mounted to front side 94 of front panel 90.

Exemplary embodiments of acoustic dampers with multiple volumes and methods described herein facilitate damping a plurality of acoustic pressure oscillations at multiple frequencies, reducing acoustic oscillations within a combustor, and reducing the number of acoustic dampers required to damp acoustic pressure oscillations. The exemplary acoustic dampers described herein include at least one wall extending from a back side of a front panel of a combustor. The wall and the back side of the front panel define a damping chamber. The back side of the front panel defines at least one outlet, and the wall defines at least one inlet. The inlet is oriented to channel a flow of air into the damping chamber, and the outlet is oriented to channel the flow of air out of the damping chamber. The damper also includes at least one separating wall that separates the damping chamber into a first volume and a second volume. At least one neck extends through the separating wall. During operations, the inlet of the acoustic damper enables passage of acoustic oscillations into the first volume, and the neck enables passage of acoustic oscillations into the second volume from the first volume. The first volume damps a first acoustic pressure oscillation at a first frequency, and the second volume damps a second acoustic pressure oscillation at a second frequency. Appropriately coupled together, these two volumes may damp a wider range of frequencies than if they were two independent Helmholtz dampers. As such, the acoustic dampers described herein damp the acoustic pressure oscillations at multiple frequencies and facilitate reducing damage to the combustor. Additionally, because the acoustic dampers described herein damp the acoustic pressure oscillations at multiple frequencies, fewer acoustic dampers are required to damp the acoustic pressure oscillations.

The methods, apparatus, and systems described herein are not limited to the specific embodiments described herein. For example, components of each apparatus or system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. An acoustic damper for a rotary machine, said acoustic damper comprising:

at least one wall extending from a back side of a front panel of a combustor and at least partially defining a damping chamber;

at least one inlet defined within said at least one wall, said at least one inlet oriented to channel a flow of air into said damping chamber;

at least one outlet defined through the front panel, said at least one outlet oriented to channel the flow of air from said damping chamber, said at least one outlet being in fluid communication with a cylindrical conduit extending from the back side of the front panel;

at least one separating wall within said damping chamber, said at least one separating wall oriented to separate said damping chamber into a first volume and a second volume, said first volume of said damping chamber having a size and shape selected to facilitate damping a first acoustic pressure oscillation at a first frequency, said second volume of said damping chamber having a size and shape selected to facilitate damping a second acoustic pressure oscillation at a second frequency that is different from the first frequency, wherein said cylindrical conduit extends through the at least one separating wall; and at least one neck extending through said at least one separating wall and axially and radially offset from said at least one outlet.

2. The acoustic damper of claim 1, wherein said at least one neck is oriented to channel a flow of air from said first volume to said second volume.

3. The acoustic damper of claim 2, wherein said at least one outlet and said at least one neck are separated a distance apart from each other.

4. The acoustic damper of claim 2, wherein said at least one wall comprises two semicircular arcs, two straight portions, and a top, said two semicircular arcs and said two straight portions extending from the back side of the front panel, and said top being positioned in contact with said two semicircular arcs and said two straight portions.

5. The acoustic damper of claim 4, wherein said at least one inlet comprises a plurality of inlets extending through at least one of said two semicircular arcs and said two straight portions.

6. The acoustic damper of claim 2, wherein said at least one wall comprises a circular wall and a conical top positioned on top of said circular wall.

7. The acoustic damper of claim 6, wherein said at least one inlet comprises a plurality of inlets extending through said circular wall.

8. A method of manufacturing an acoustic damper on a front panel of a combustor, said method comprising:

defining an outlet through the front panel, the outlet extending from a front side of the front panel to a back side of the front panel, the outlet being in fluid communication with a cylindrical conduit extending from the back side of the front panel;

forming at least one wall on the back side of the front panel, the at least one wall and the back side of the front panel defining a damping chamber;

defining at least one inlet within the at least one wall; and forming at least one separating wall within the damping chamber surrounding the cylindrical conduit, the at least one separating wall being configured to separate the damping chamber into a first volume and a second volume, the first volume having a size and shape selected to facilitate damping an acoustic pressure oscillation at a first frequency, and the second volume having a size and shape selected to facilitate damping the acoustic pressure oscillation at a second frequency that is different from the first frequency, wherein said cylindrical conduit extends through the at least one separating wall; and forming at least one neck extending through the at least one separating wall, wherein the at least one neck is axially and radially offset from the outlet.

9. A rotary machine comprising:

at least one combustor comprising a front panel having a front side and an opposing back side; and at least one acoustic damper positioned on said back side of the front panel, said at least one acoustic damper comprising:

at least one wall extending from the back side of the front panel and at least partially defining a damping chamber;

at least one inlet defined within said at least one wall, said at least one inlet oriented to channel a flow of air into said damping chamber;

at least one outlet defined through the front panel, said at least one outlet oriented to channel the flow of air out of said damping chamber, said at least one outlet being in fluid communication with a cylindrical conduit extending from the back side of the front panel;

at least one separating wall within said damping chamber, said at least one separating wall oriented to separate said damping chamber into a first volume and a second volume, said first volume of said damping chamber having a size and shape selected to facilitate damping an acoustic pressure oscillation at a first frequency, said second volume of said damping chamber having a size and shape selected to facilitate damping the acoustic pressure oscillation at a second frequency that is different from the first frequency, wherein said cylindrical conduit extends through the at least one separating wall; and at least one neck extending through said at least one separating wall and axially and radially offset from said at least one outlet.

* * * * *